US007780797B2

(12) United States Patent
Okamoto et al.

(10) Patent No.: US 7,780,797 B2
(45) Date of Patent: Aug. 24, 2010

(54) HIGH STRENGTH THIN STEEL EXCELLENT IN HOLE EXPANSIBILITY, DUCTILITY AND CHEMICAL TREATMENT CHARACTERISTICS

(75) Inventors: Riki Okamoto, Tokai (JP); Hirokazu Taniguchi, Tokai (JP)

(73) Assignee: Nippon Steel Corporation, Tokyo (JP)

( * ) Notice: Subject to any disclaimer, the term of this patent is extended or adjusted under 35 U.S.C. 154(b) by 249 days.

(21) Appl. No.: 10/540,418

(22) PCT Filed: Dec. 24, 2003

(86) PCT No.: PCT/JP03/16614

§ 371 (c)(1),
(2), (4) Date: Jun. 24, 2005

(87) PCT Pub. No.: WO2004/059024

PCT Pub. Date: Jul. 15, 2004

(65) Prior Publication Data

US 2006/0113012 A1 Jun. 1, 2006

(30) Foreign Application Priority Data

Dec. 26, 2002 (JP) ..... 2002-377097
Oct. 17, 2003 (JP) ..... 2003-357281

(51) Int. Cl.
*C22C 38/04* (2006.01)
*C22C 38/06* (2006.01)
*C22C 38/14* (2006.01)

(52) U.S. Cl. ..... 148/320; 148/326; 148/331

(58) Field of Classification Search ..... 148/320, 148/330–337, 326, 603, 654; 420/8, 103, 420/120, 123, 126, 127
See application file for complete search history.

(56) References Cited

U.S. PATENT DOCUMENTS 5,470,529 A 11/1995 Nomura et al.
6,290,784 B1 * 9/2001 Yasuhara et al. ..... 148/320
6,589,369 B2 * 7/2003 Yokoi et al. ..... 148/320

FOREIGN PATENT DOCUMENTS

CN 1251140 A 7/2000

(Continued)

OTHER PUBLICATIONS

Computer-generated English translation of Japanese patent 11-323480, Adachi Yoshitaka et al. Nov. 26, 1999.*

(Continued)

*Primary Examiner*—Deborah Yee
(74) *Attorney, Agent, or Firm*—Kenyon & Kenyon LLP

(57) ABSTRACT

High strength hot rolled steel sheet having at least a 590 N/mm$^2$ tensile strength and excellent in elongation and ability of phosphate coating, that is, high strength hot rolled steel sheet excellent in burring, elongation, and ability of phosphate coating having a tensile strength of 590 N/mm$^2$ or more comprising a steel composition containing, by mass %, C: 0.02 to 0.08%, Si: 0.50% or less, Mn: 0.50 to 3.50%, P: 0.03% or less, S: 0.01% or less, Al: 0.15 to 2.0%, and the balance of iron and unavoidable impurities, satisfying Mn+0.5×Al<4, having a microstructure of the steel sheet having a ratio of ferrite having a grain size of 2 μm or more of 40% or more.

3 Claims, 2 Drawing Sheets

FOREIGN PATENT DOCUMENTS

| | | | |
|---|---|---|---|
| EP | 0 881 308 | A1 | 12/1998 |
| EP | 0 969 112 | | 1/2000 |
| EP | 0 974 677 | | 1/2000 |
| EP | 1 001 041 | A1 | 5/2000 |
| EP | 1149925 | | 10/2001 |
| EP | 1 154 028 | A1 | 11/2001 |
| EP | 1201780 | | 5/2002 |
| EP | 1 213 368 | | 6/2002 |
| JP | 3-180426 | | 8/1991 |
| JP | 4-88125 | | 3/1992 |
| JP | 5-112846 | | 5/1993 |
| JP | 6-33140 | | 2/1994 |
| JP | 6-128688 | | 5/1994 |
| JP | 6-172924 | | 6/1994 |
| JP | 6-200351 | | 7/1994 |
| JP | 6-293910 | | 10/1994 |
| JP | 7-11382 | | 1/1995 |
| JP | 07252592 | | 10/1995 |
| JP | 11 323480 | | 11/1999 |
| JP | 2000-63955 | | 2/2000 |
| JP | 2000-144261 | | 5/2000 |
| JP | 2000-319756 | | 11/2000 |
| JP | 2001-32041 | | 2/2001 |
| JP | 2001-303186 | | 10/2001 |
| JP | 2002-129285 | * | 5/2002 |
| JP | 2002-180190 | | 6/2002 |
| JP | 2003-342684 | | 12/2003 |
| JP | 2004-27249 | | 1/2004 |
| WO | WO 03/010351 | | 2/2003 |

OTHER PUBLICATIONS

European Search Report dated Jan. 13, 2006, EP 03 78 6277.

* cited by examiner

HIGH STRENGTH THIN STEEL EXCELLENT IN HOLE EXPANSIBILITY, DUCTILITY AND CHEMICAL TREATMENT CHARACTERISTICS

TECHNICAL FIELD

The present invention high strength hot rolled steel sheet excellent in burring, elongation, and ability of phosphate coating used mainly for press worked automotive chassis parts, having a thickness of 0.6 to 6.0 mm or so, and having a strength of 590 N/mm$^2$ or more and a method of production of the same.

BACKGROUND ART

In recent years, car bodies have been made lighter in weight as means for improving the fuel efficiency due to the environmental problems raised by automobiles and a strong need has arisen for reducing costs by forming parts integrally and streamlining the working processes. High strength hot rolled steel sheet excellent in press workability has therefore been developed. In the past, as such high strength hot rolled steel sheet having a high workability, steel with a mixed structure of a ferrite and martensite structure or ferrite and bainite structure or steel with a substantially single phase structure of mainly bainite or ferrite have been widely known.

In particular, steel of a ferrite and martensite structure has the characteristics of a high ductility and excellent fatigue characteristics, so is being used for automobile wheels etc. For example, Japanese Unexamined Patent Publication (Kokai) No. 6-33140 discloses steel of a ferrite and martensite structure where the amounts of addition of Al and N in the ferrite and martensite structure are adjusted so as to leave solid solution N and obtain a high ageing hardening and thereby obtain a high fatigue strength, but in a ferrite and martensite structure, microvoids form around the martensite from the beginning of deformation and lead to cracking, so there is the problem of poor burring. This made the steel unsuitable for applications such as chassis parts demanding a high burring.

Further, Japanese Unexamined Patent Publication (Kokai) No. 4-88125 and Japanese Unexamined Patent Publication (Kokai) No. 3-180426 disclose steel sheet having a structure mainly comprised of bainite, but since the structure is mainly comprised of bainite, while the burring is excellent, there is little of the soft ferrite phase, so the ductility is poor. Further, Japanese Unexamined Patent Publication (Kokai) No. 6-172924 and Japanese Unexamined Patent Publication (Kokai) No. 7-11382 disclose steel sheet having a structure mainly comprised of ferrite, but similarly while the burring is excellent, hard carbides are made to precipitate in order to secure strength, so the ductility is poor.

Further, Japanese Unexamined Patent Publication (Kokai) No. 6-200351 discloses steel sheet excellent in burring and ductility having a ferrite and bainite structure, while Japanese Unexamined Patent Publication (Kokai) No. 6-293910 discloses a method of production of steel sheet achieving both burring and ductility by use of two-stage cooling to control the ratio of ferrite. However, due to the further reduction in weight, complexity of parts, etc. of automobiles, further higher burring and ductility are sought. Recent high strength, hot rolled steel sheets are being pressed to provide an advance level of workability not able to be handled by the above technology.

Further, Japanese Unexamined Patent Publication (Kokai) No. 2002-180190 discloses an invention relating to high strength hot rolled steel sheet excellent in burring and ductility. While high strength hot rolled steel sheet excellent in the contradictory characteristics of burring and ductility has been obtained, in the hot rolling process, surface defects known as Si scale sometimes occurred resulting in damage to the appearance of the product. Further, high strength hot rolled steel sheet for chassis parts etc. usually is chemically converted and painted after press working. However, problems sometimes arose such as cases of poor formation of the chemical conversion coating (poor chemical conversion) or cases of poor adhesion of the paint after application. These problems are believed to be due to the large amount of Si contained in the steel. In this way, Si is often used for high strength hot rolled steel sheet, but various types of trouble arise.

Further, Japanese Unexamined Patent Publication (Kokai) No. 6-128688 discloses technology for adjusting the hardness of the ferrite phase in a ferrite and martensite structure so as to improve the durability and achieve both ductility and fatigue strength. Further, Japanese Unexamined Patent Publication (Kokai) No. 2000-319756 discloses technology for adding Cu to a ferrite and martensite structure so as to strikingly improve the fatigue characteristics while maintaining the ductility. In both cases, however, to secure sufficient ferrite in the hot rolling process, the amount of Si added becomes high, so in the hot rolling process, surface defects known as Si scale are formed in some cases and the appearance of the product is damaged in some cases. Further, high strength hot rolled steel sheet for chassis parts etc. normally is chemically converted and painted after press working. However, problems sometimes arose such as cases of poor formation of the chemical conversion coating (poor chemical conversion) or cases of poor adhesion of the paint after application.

DISCLOSURE OF THE INVENTION

The present invention was made so as to solve the above conventional problems and provides high strength hot rolled steel sheet excellent in elongation and remarkably improved in ability of phosphate coating by preventing the drop in elongation accompanying an increase of strength to a tensile strength of 590 N/mm$^2$ or more and further by preventing the formation of Si scale. That is, the present invention has as its object to provide high strength hot rolled steel sheet excellent in burring, elongation, and ability of phosphate coating and a method of production of that steel sheet. Its gist is as follows:

(1) High strength hot rolled steel sheet excellent in burring, elongation, and ability of phosphate coating characterized by being a steel composition containing, by mass %, C: 0.02 to 0.08%, Si: 0.50% or less, Mn: 0.50 to 3.50%, P: 0.03% or less, S: 0.01% or less, Al: 0.15 to 2.0%, and the balance of iron and unavoidable impurities, satisfying the following formula, having a microstructure of said steel sheet having a ratio of ferrite of a grain size of 2 μm or more of at least 40%, and having a tensile strength of at least 590 N/mm$^2$:

$$Mn+0.5\times Al<4 \quad (1)$$

(2) High strength hot rolled steel sheet excellent in burring, elongation, and ability of phosphate coating characterized by having a tensile strength of at least 590 N/mm$^2$ as set forth in (1), further containing, by mass %, one or two or more of Ti: 0.003% to 0.20%, Nb: 0.003% to 0.04%, V: 0.003% to 0.20%, Ca: 0.0005 to 0.01%, Zr: 0.0005 to 0.01%, a REM: 0.0005 to 0.05%, and Mg: 0.0005 to 0.01%.

(3) High strength hot rolled steel sheet excellent in burring, elongation, and ability of phosphate coating characterized by having a tensile strength of at least 590 N/mm$^2$ as set forth in (1) or (2), characterized by satisfying $0.3\times Al+Si-2\times Mn \geqq -4$ . . . (2) and having a microstructure of a grain size 2 μm or more ferrite and martensite two-phase structure.

(4) High strength, hot rolled steel sheet excellent in burring, elongation and ability of phosphate coating characterized by having a tensile strength of at least 590 $N/mm^2$ as set forth in (1) or (2), characterized by having a microstructure of a grain size 2 μm or more ferrite and bainite two-phase structure.

(5) A method of production of high strength hot rolled steel sheet excellent in burring, elongation, and ability of phosphate coating characterized by having a tensile strength of 590 $N/mm^2$ or more characterized by ending hot rolling of a slab comprised of a steel composition as set forth in any one of (1) to (3) at a rolling end temperature of the $Ar_3$ point or more, then cooling it by a cooling rate of 20° C./sec or more until 650° C. to 750° C., then air cooling it for 2 to 15 seconds, further cooling it, then coiling it at a temperature of less than 300° C.

(6) A method of production of high strength hot rolled steel sheet excellent in burring, elongation, and ability of phosphate coating characterized by having a tensile strength of 590 $N/mm^2$ or more, characterized by ending hot rolling of a slab comprised of a steel composition as set forth in any one of (1), (2), and (4) at a rolling end temperature of the $Ar_3$ point or more, then cooling it by a cooling rate of 20° C./sec or more to 650 to 800° C., then air cooling it for 2 to 15 seconds, then further cooling it by a cooling rate of 20° C./sec or more to 350 to 600° C. and coiling it.

BEST MODE FOR WORKING THE INVENTION

Figure 1:
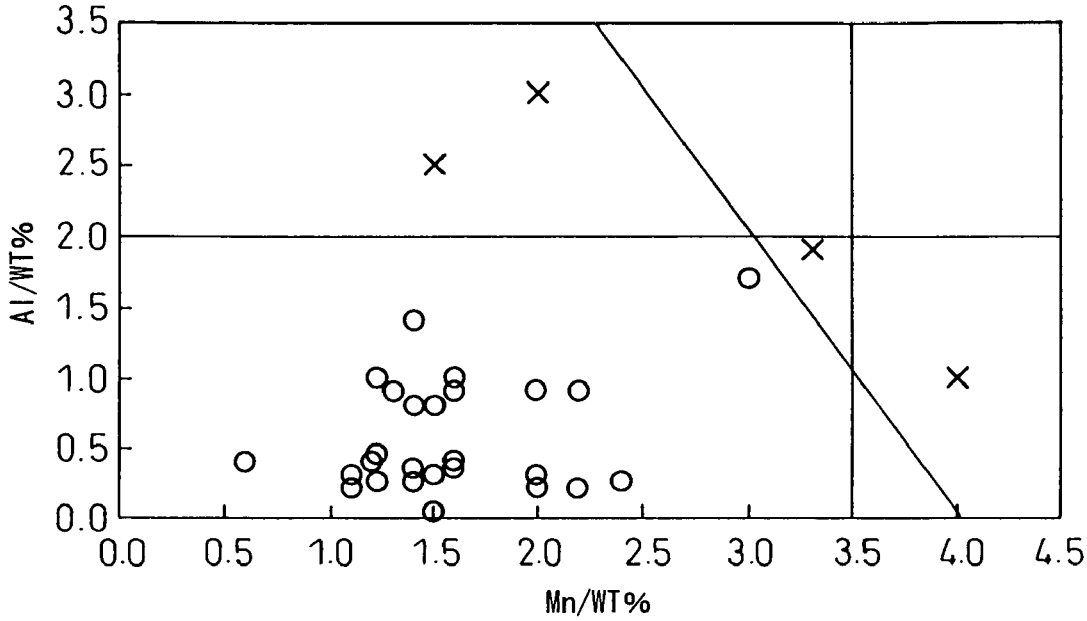
FIG. 1 is a view of the relationship between Al and Mn and ability of phosphate coating.

In conventional ferrite and martensite steel, securing ductility requires that a sufficient ferrite structure percentage be secured. A high amount of addition of Si was essential. However, if the amount of addition of Si becomes high, surface defects known as Si scale are formed in some cases. It is known that these damage the appearance of the product and cause deterioration of the ability of phosphate coating. The inventors engaged in intensive studies to solve these problems and as a result discovered that to obtain a sufficient ferrite percentage in ferrite and martensite steel, addition of Al is effective. They learned that by adjusting the Mn and the Al and Si ingredients and making the ferrite grains at least a certain size as much as possible, even with a low amount of Si added, sufficient burring and elongation are obtained. Further, they discovered that by adjusting the Al and Mn, deterioration of the ability of phosphate coating can be suppressed. By this, the inventors completed the present invention. That is, the inventors newly discovered that by making the specific microstructure of the steel sheet a low C-low Si-high Al system with Mn and Al and Si in a specific relationship, high strength hot rolled steel sheet achieving high burring, elongation, and ability of phosphate coating can be obtained. Further, the inventors discovered an industrially advantageous method of production for this.

Further, the present invention takes note of steel with a substantially two-phase structure of ferrite and bainite where the ferrite improves the elongation and precipitates comprised of TiC, NbC, and VC secure the strength and causes sufficient growth of the ferrite grains to improve the elongation without lowering the burring, then causes the formation of precipitates to secure the strength so as to thereby solve the above problems. That is, the inventors newly discovered that by obtaining a specific microstructure of the present invention steel sheet comprising a low C-low Si-high Al(Ti, Nb, V) system and having Mn and Al in a specific relationship, high strength hot rolled steel sheet simultaneously satisfying the three characteristics of burring, elongation, and ability of phosphate coating is obtained. Further, they discovered an industrially advantageous method of production for the same. Note that (Ti, Nb, V) means inclusion of a specific amount of one or more of Ti, Nb, and V.

Below, the reasons for limitation of the elements of the steel composition will be explained.

C is included in an amount of 0.02% to 0.08%. C is an element necessary for strengthening the martensite phase and securing strength. If less than 0.02%, the desired strength is hard to secure. On the other hand, if over 0.08%, the drop in the elongation becomes great, so the amount is made 0.02% to 0.08%.

Si is an important element for suppressing the formation of harmful carbides and obtaining a complex structure of mainly a ferrite structure plus residual martensite, but causes a deterioration of the ability of phosphate coating and also forms Si scale, so 0.5% is made the upper limit. If over 0.25%, at the time of production of hot rolled steel sheet, the temperature control for obtaining the above microstructure sometimes is severe, so the Si content is more preferably 0.25% or less.

Mn is an element necessary for securing strength. Therefore, 0.50% or more must be added. However, if added in a large amount over 3.5%, micro segregation and macro segregation easily occur, the burring is deteriorated, and a deterioration in the ability of phosphate coating is also seen, to secure ability of phosphate coating without causing deterioration of the elongation, the range of Mn must be 0.50% to 3.50%.

P dissolves in the ferrite and causes the elongation to drop, so its content is made 0.03% or less. Further, S forms MnS which acts as a starting point for breakage and remarkably lowers the burring and elongation, so the content is made 0.01% or less.

Al is one of the important elements in the present invention and is necessary for achieving both elongation and ability of phosphate coating. Therefore, 0.15% or more must be added. Al was an element conventionally considered necessary for deoxidation in hot rolled steel sheet and normally was added in an amount of 0.01 to 0.07% or so. The inventors ran various experiments on high strength hot rolled steel sheets based on steel compositions of low C-low Si systems including remarkably large amounts of Al and different in metal structure and thereby reached the present invention. That is, they discovered that by including Al in an amount of 0.15% or more and forming the above microstructure, it is possible to greatly improve the elongation without damaging the ability of phosphate coating. With an amount of Al of 2.0%, the effect of improvement of the elongation becomes saturated. Not only this, but if added in an amount over 2.0%, achievement of both elongation and ability of phosphate coating conversely ends up becoming difficult, so the content is made 0.15% to 2.0%.

For achievement of both elongation and ability of phosphate coating, it is also important to define the relationship between Mn and Al. While the reason is unclear, the inventors newly discovered that under conditions of Si of 0.5% or less, as shown in FIG. 1, under conditions of $$Mn+0.5\times Al<4 \quad (1)$$

the ability of phosphate coating is not damaged.

Hot rolled steel sheet has to finish being controlled in microstructure in the extremely short time of ROT cooling. Up until now, the microstructure was controlled during cooling by increasing the amount of addition of Si, but if the amount of addition of Si increases, there is the problem that deterioration of the ability of phosphate coating is induced. Deterioration of the elongation of types of steel requiring ability of phosphate coating was unavoidable. Therefore, the inventors engaged in intensive studies on techniques for improving the ability of phosphate coating without causing the elongation to deteriorate and newly discovered Al as an element which, like Si, forms ferrite and yet does not induce deterioration of the ability of phosphate coating and further does not cause deterioration of other aspects of quality. Further, the inventors engaged in repeated studies on the control of the microstructure in a short time in addition of low Si-high Al, which was not clear up to now, and discovered that particularly in the low Si-high Al region in the region of addition of a high amount of Al of 0.15% or more, control of the microstructure in a short time is difficult unless considering the addition of Si, Al, and Mn. By clarifying their individual effects, the inventors arrived at the right side of formula (2). When this value is −4 or more, even with short treatment such as hot rolling ROT, a sufficient ferrite phase can be secured and a high elongation can be obtained. On the other hand, when this value is less than −4, the ferrite phase insufficiently grows and deterioration of the elongation is induced. From this, the inventors obtained the condition of formula (2).

$$0.3\times Al+Si-2\times Mn\geqq -4 \quad (2)$$

Ti, Nb, and V cause the precipitation of fine carbides such as TiC, NbC, and VC and enable higher strength. For this purpose, it is necessary to add one or more of Ti in an amount of 0.003 to 0.20%, Nb in an amount of 0.003% to 0.04%, and V in an amount of 0.003% to 0.20%. With an amount of Ti, Nb, or V of less than 0.003%, it is difficult to obtain a rise in strength through precipitation strengthening, while if Ti exceeds 0.20%, Nb exceeds 0.04%, or V exceeds 0.20%, too large an amount of precipitate is formed and the elongation deteriorates. Further, for further effective use of precipitates of Ti, Nb, and V, Ti is preferably contained in an amount of 0.020% or more, Nb in an amount of 0.010% or more, and V in an amount of 0.030% or more.

Ca, Zr, and REMs are elements effective for controlling the morphology of sulfide-based inclusions and improving the burring. To make their effects of control of the morphology more effective, it is preferable to add one or more of Ca, Zr, and a REM in an amount of at least 0.0005%. On the other hand, addition of large amounts induces coarsening of the sulfide-based inclusions and causes deterioration of the cleanliness. Even in low C-low Si-high Al ingredient system of the present invention, not only is the elongation lowered, but also a rise in the cost is induced, so the upper limit of Ca and Zr is made 0.01% and the upper limit of a REM is made 0.05%. Further, as a REM, for example, there are the elements of the Element Nos. 21, 39, and 57 to 71.

As unavoidable impurities, even if containing for example N≦0.01%, Cu≦0.3%, Ni≦0.3%, Cr≦0.3%, Mo≦0.3%, Co≦0.05%, Zn≦0.05%, Na≦0.02%, K≦0.02%, and B≦0.0005%, the present invention is not exceeded.

Figure 2:
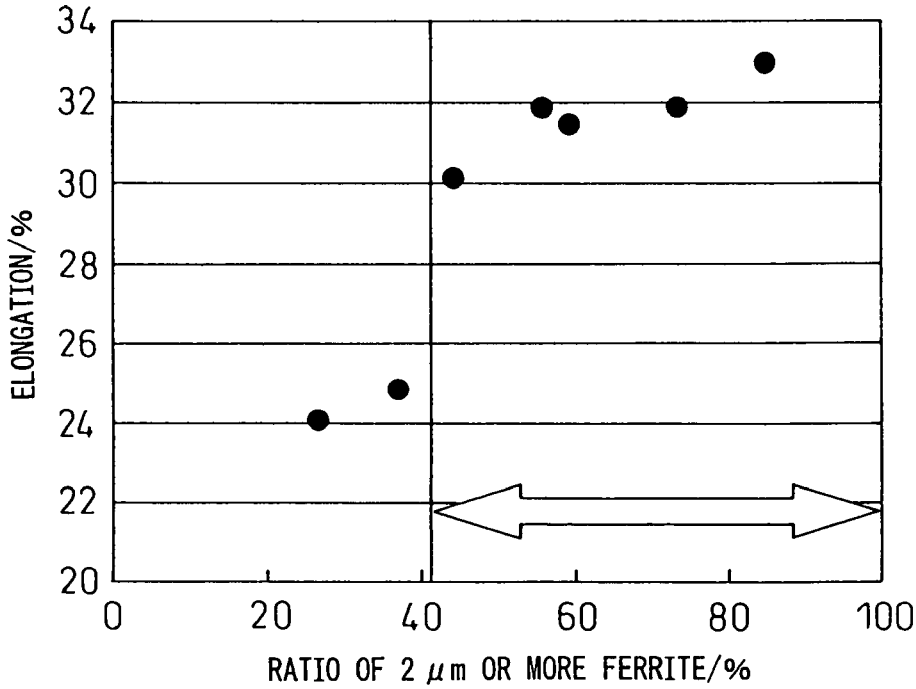
FIG. 2 is a view of the relationship between the 2 μm or larger ferrite percentage and the elongation.

The size of the ferrite grains is one of the most important indicators in the present invention. The inventors engaged in intensive research and as a result discovered that if the area ratio of ferrite having a grain size of 2 μm or more is 40% or more, the result is steel sheet excellent in elongation. FIG. 2 shows the relationship between the ratio of ferrite having a grain size of 2 μm or more and the elongation. This shows that if the ratio of ferrite having a grain size of 2 μm or more is 40% or more, the steel sheet exhibits a high elongation.

This is believed to be because if the grain size is less than 2 am, the individual crystal grains will not sufficiently recover and grow and will therefore cause a drop in the elongation. Therefore, to achieve both good burring and elongation, it is necessary to make the ratio of ferrite having a grain size of 2 μm or more 40% or more. Note that to obtain a more remarkable effect, the ratio of ferrite having a grain size of 3 μm or more being 40% or more is preferable. Further, the grain size can be found by converting the area of the individual grains to circle equivalent diameters.

The microstructure of the high strength hot rolled steel sheet is to be comprised of ferrite and martensite. Here, since the microstructure contains ferrite with a grain size of 2 μm or more in an amount of 40% or more, the microstructure becomes a ferrite and martensite two-phase structure with ferrite in an amount of 40% or more. For example, as the microstructure of the present invention, one comprised of 40% or more of ferrite of a grain size of 2 μm or more and the balance of ferrite with a grain size of less than 2 μm and martensite or one comprised of 40% or more of ferrite of a grain size of 2 μm or more and the balance of only martensite may be used. The martensite is made 60% or less in this way because if the amount of martensite becomes greater than that, the drop in elongation becomes remarkably large. However, even if residual austenite is contained in an amount of about 1% as measured by usual X-ray diffraction intensity, the ferrite and martensite two-phase structure of the present invention is not exceeded. Further, even if the region near the surface of the hot rolled steel sheet has a partial region of extremely thin (for example, about 0.1 to 0.3 mm or so) carbon or another steel ingredient somewhat low, while the microstructure may differ somewhat, so long as the majority of the hot rolled steel sheet in the thickness direction is comprised of a microstructure of said ferrite and martensite two-phase structure with ferrite of a grain size of 2 μm contained in an amount of 40% or more, the action and effect of the present invention will remain.

The present invention provides high strength hot rolled steel sheet having said steel composition and microstructure and further an industrially advantageous method of production of high strength hot rolled steel sheet for producing that steel sheet.

When producing high strength hot rolled steel sheet by hot rolling, with the low C-low Si-high Al system of the present invention, the finish rolling end temperature preferably is made the $Ar_3$ point or more so as to suppress the drop in elongation due to the rolling of the ferrite region. However, if the temperature is too high, the coarsening of the microstructure will induce a drop in the strength and elongation in some cases, so the finish rolling end temperature is preferably 1050° C. or less. Whether or not to heat the slab should be suitably determined by the rolling conditions of the steel sheet, while whether to bond the hot rolled steel sheet with the next hot rolled steel sheet or slab during the hot rolling for continuous rolling should be suitably selected according to whether the microstructure of the present invention can be obtained. Further, the steel may be melted by a converter system or an electric furnace system. It is sufficient that the melting give the above steel composition. Further, hot metal pretreatment, refining, degasification, etc. for controlling the impurities etc. should be suitably selected.

Rapidly cooling the steel sheet right after the end of the finish rolling is important for securing the ferrite ratio. The cooling rate is preferably 20° C./sec or more. This is because if less than 20° C./sec, pearlite, which causes a drop in strength and a drop in elongation, is formed. Further, at 250° C./sec, the effect of suppression of pearlite becomes saturated, but even over 250° C./sec, the ferrite crystal grains grow and ferrite with a grain size of 2 μm or more can be secured in an amount of 40% or more of the microstructure. If over 600° C./sec, the effect of growth of the ferrite crystal grains also becomes saturated and conversely maintenance of the shape of the hot rolled steel sheet becomes no longer easy under the present circumstances, so 600° C./sec or less is preferable.

It is important to stop the rapid cooling of the steel sheet once and air-cool the sheet in order to cause ferrite to precipitate and increase its ratio and improve the elongation. However, if the air cooling start temperature is less than 650° C., pearlite harmful to the burring is formed early. On the other hand, if the air cooling start temperature is over 750° C., the formation of ferrite is slow and the effect of air-cooling is hard to obtain. Not only that, pearlite easily forms during the subsequent cooling. Therefore, this is not desirable. Therefore, the air cooling start temperature is preferably 650 to 750° C. Further, even if the air cooling time is over 15 seconds, not only will the effect of increase in ferrite become saturated, but also the formation of pearlite will cause a drop in the strength and elongation. Further, a load will be placed on the subsequent control of the cooling rate and coiling temperature, so this is industrially not preferable. Therefore, the air cooling time is made 15 seconds or less. Note that with an air cooling time of less than 2 seconds, the ferrite cannot be made to sufficiently precipitate, so this is not preferable. Further, the air cooling of the present invention includes, to an extent not having an effect on the formation of the subsequent microstructure, blowing a small amount of a mist-like coolant for the purpose of changing the scale near the surface of the hot rolled steel sheet.

After the air cooling, the hot rolled steel sheet is again rapidly cooled. The cooling rate again has to be at least 20° C./sec. If less than 20° C./sec, harmful pearlite is easily formed, so this is not preferable. The effect of formation of bainite substantially becomes saturated at 200° C./sec. Further, over 600° C., sometimes the steel sheet is partially overcooled and local fluctuations in hardness occur, so this is not preferable.

Further, the stopping temperature of this rapid cooling (secondary rapid cooling), that is, the coiling temperature, is made 300 to 600° C. If the coiling temperature is less than 350° C., hard martensite detrimental to the burring is formed. On the other hand, if over 600° C., pearlite detrimental to the burring is easily formed.

By combining the present steel composition and hot rolling conditions as explained above, it is possible to produce high strength hot rolled steel sheet excellent in burring, elongation, and ability of phosphate coating having a tensile strength of 590 N/mm$^2$ or more, where the microstructure of the steel sheet is a ferrite and martensite two-phase structure having a percent of ferrite having a grain size of 2 μm or more of 40% or more. Further, even if the steel sheet of the present invention is treated on its surface (for example, coated with zinc or lubricated), the effect of the present invention stands and the present invention is not exceeded.

EXAMPLE 1

Steels having the chemical compositions shown in Table 1-1 and Table 1-2 (content in mass %, blank fields indicating none added) were melted in converters and continuously cast into slabs which were then rolled under the hot rolling conditions shown in Table 2 and cooled to thereby produce hot rolled steel sheets of thicknesses of 2.6 (Examples 1 to 16 and Comparative Examples 1 to 3) and 3.2 mm (Examples 17 to 32 and Comparative Examples 4 to 6). Note that the rate of rapid cooling was made 40° C./sec (Examples 1 to 15 and Comparative Examples 1 to 4), 120° C./sec (Examples 16 to 30 and Comparative Example 5), and 300° C./sec (Examples 31 and 32 and Comparative Example 6), and the air cooling time was made 10 seconds (Examples 1 to 32 and Comparative Examples 1 to 6). However, the finish rolling end temperature of the hot rolling was 900° C. (Examples 1 to 32 and Comparative Examples 4 to 9) and 930° C. (Comparative Examples 1 to 3).

The thus obtained hot rolled steel sheets were subjected to tensile tests and burring tests, were observed for microstructure, and were evaluated for ability of phosphate coating. The results are shown in Table 2-1 and Table 2-2.

Note 1) Tensile Strength and Elongation

The test pieces were subjected to tensile tests using JIS No. 5 pieces based on JIS Z 2201.

Note 2) Burring

The burring tests were conducted by widening a punched hole having an initial hole diameter (d0: 10 mm) by a 60° conical punch and finding the burring value (λ value)=(d−d0)/d0×100 from the hole diameter (d) when the crack passed through the sheet thickness so as to evaluate the burring. The results are shown in Table 2.

Note 3) Microstructure of Steel Sheet

In observing the microstructure, the sheet was corroded by Nytal, then a scan type electron microscope was used to identify the ferrite and bainite. The area ratio of ferrite of a grain size of 2 μm or more was measured by image analysis.

Note 4) Ability of Phosphate Coating

For the ability of phosphate coating of hot rolled steel sheet, the surface scale was removed, then a phosphate coating solution SD5000 (made by Nippon Paint) was used for test of phosphate coating after the prescribed degreasing and surface conditioning. The phosphate coating was judged by SEM (scanning electron microscopy) with uniformly formed coatings judged as "G (good)" and partially formed coatings as "P (poor)".

Examples 1 to 32 are examples of the present invention having all of the chemical ingredients, finish rolling end temperature, air cooling start temperature, and coiling temperature in the scope of the present invention, having microstructures comprised of the two phases of ferrite and bainite, and having percents of ferrite having a grain size of 2 μm or more of 40% or more, i.e., are high strength hot rolled steel sheet excellent in burring, elongation, and ability of phosphate coating having high λ values and elongation. On the other hand, the sheets of the comparative examples of Comparative Examples 1 to 9 deviated from the conditions of the present invention are inferior in the balance of strength, burring, and elongation and in the ability of phosphate coating.

Further, while not shown in Table 1 and Table 2, when using a slab of the steel ingredients shown in Example 1 and hot rolling it at a hot rolling end temperature of 920° C., then cooling it to 625° C. by primary rapid cooling (cooling rate of 40° C./sec), air-cooling it by an air cooling start temperature of 625° C. for 10 seconds, and further cooling it by secondary rapid cooling (cooling rate of 20° C./sec, to obtain a coiling temperature of 460° C., since the air cooling start temperature was lower than the scope of the present invention, several percent of pearlite formed in the microstructure and the area ratio of ferrite having a grain size of 2 μm or more was a low 36% or outside the scope of the present invention. Therefore, the elongation became 19% and the λ value became 95%, so the balance of burring and elongation was poor. Further, when similarly using a slab of the steel ingredients shown in Example 1 and hot rolling it at a hot rolling end temperature of 910° C., then cooling it to 675° C. by primary rapid cooling (cooling rate of 100° C./sec), air cooling it by an air cooling start temperature of 680° C. for 10 seconds, then further cooling it by secondary rapid cooling (cooling rate of 20° C./sec) to obtain a coiling temperature of 320° C., since the coiling temperature was lower than the scope of the present invention, 10% or so of martensite formed in the microstructure and the area ratio of ferrite having a grain size of 2 μm or more was a low 33%, so the elongation became 20%, the λ value became 63%, and again the balance of the burring and elongation ended up becoming poor.

TABLE 1-1

| | Steel composition (mass %) | | | | | | | | | | | | | | |
|---|---|---|---|---|---|---|---|---|---|---|---|---|---|---|---|
| | C | Si | Mn | P | S | N | Al | Nb | Ti | V | Ca | Zr | REM | Mg | Mn + 0.5 Al |
| Ex. 1 | 0.03 | 0.01 | 1.50 | 0.015 | 0.0100 | 0.0030 | 0.40 | 0.010 | 0.020 | 0.050 | | | | | 1.70 |
| Ex. 2 | 0.03 | 0.01 | 1.23 | 0.015 | 0.0100 | 0.0030 | 0.60 | 0.040 | 0.200 | 0.050 | | | | | 1.53 |
| Ex. 3 | 0.03 | 0.005 | 3.00 | 0.001 | 0.0020 | 0.0005 | 1.10 | 0.020 | 0.060 | 0.100 | | | | | 3.55 |
| Ex. 4 | 0.03 | 0.02 | 2.40 | 0.005 | 0.0050 | 0.0010 | 1.40 | 0.010 | 0.050 | | 0.0025 | | | 0.0025 | 3.10 |
| Ex. 5 | 0.03 | 0.02 | 0.60 | 0.012 | 0.0060 | 0.0050 | 2.00 | 0.000 | 0.150 | 0.100 | | 0.0025 | | | 1.60 |
| Ex. 6 | 0.04 | 0.30 | 1.60 | 0.030 | 0.0100 | 0.0030 | 0.40 | 0.020 | | 0.060 | | | | 0.0025 | 1.80 |
| Ex. 7 | 0.05 | 0.01 | 2.50 | 0.040 | 0.0020 | 0.0100 | 0.50 | 0.010 | | 0.040 | | | | 0.0040 | 2.75 |
| Ex. 8 | 0.04 | 0.01 | 1.56 | 0.030 | 0.0010 | 0.0080 | 0.80 | 0.040 | 0.030 | 0.060 | 0.0025 | | | 0.0060 | 1.96 |
| Ex. 9 | 0.04 | 0.005 | 0.56 | 0.015 | 0.0010 | 0.0009 | 1.40 | 0.020 | 0.100 | | 0.0010 | | | | 1.26 |
| Ex. 10 | 0.05 | 0.02 | 1.23 | 0.012 | 0.0015 | 0.0020 | 2.00 | 0.010 | 0.050 | 0.010 | 0.0080 | | 0.0025 | 0.0350 | 2.23 |
| Ex. 11 | 0.05 | 0.02 | 2.50 | 0.012 | 0.0020 | 0.0025 | 0.70 | | 0.030 | 0.000 | | 0.0060 | 0.0040 | | 2.85 |
| Ex. 12 | 0.05 | 0.015 | 1.00 | 0.015 | 0.0040 | 0.0035 | 0.60 | 0.020 | 0.020 | 0.070 | | | 0.0060 | | 1.30 |
| Ex. 13 | 0.07 | 0.20 | 0.70 | 0.020 | 0.0020 | 0.0040 | 0.80 | 0.010 | 0.040 | 0.020 | | | | | 1.10 |
| Ex. 14 | 0.06 | 0.01 | 0.56 | 0.008 | 0.0100 | 0.0025 | 1.40 | 0.040 | 0.100 | 0.050 | | | | 0.0320 | 1.26 |
| Ex. 15 | 0.06 | 0.02 | 1.80 | 0.012 | 0.0100 | 0.0020 | 1.70 | | 0.050 | | | | 0.0025 | 0.0100 | 2.65 |
| Ex. 16 | 0.06 | 0.02 | 1.56 | 0.012 | 0.0040 | 0.0025 | 0.40 | 0.010 | 0.030 | 0.030 | 0.0025 | | 0.0040 | 0.0100 | 1.76 |
| Ex. 17 | 0.08 | 0.015 | 0.60 | 0.015 | 0.0010 | 0.0035 | 0.50 | | 0.080 | 0.070 | 0.0010 | | 0.0060 | | 0.85 |
| Ex. 18 | 0.08 | 0.01 | 3.50 | 0.016 | 0.0100 | 0.0040 | 0.80 | 0.020 | 0.040 | 0.020 | 0.0080 | | | | 3.90 |
| Ex. 19 | 0.08 | 0.01 | 3.00 | 0.008 | 0.0020 | 0.0025 | 1.40 | 0.010 | 0.230 | 0.050 | | 0.0080 | | | 3.70 |
| Ex. 20 | 0.08 | 0.005 | 1.56 | 0.002 | 0.0010 | 0.0015 | 2.00 | 0.040 | 0.150 | 0.030 | | | | | 2.56 |

TABLE 1-2

| | Steel composition (mass %) | | | | | | | | | | | | | | |
|---|---|---|---|---|---|---|---|---|---|---|---|---|---|---|---|
| | C | Si | Mn | P | S | N | Al | Nb | Ti | V | Ca | Zr | REM | Mg | Mn + 0.5 Al |
| Ex. 21 | 0.05 | 0.01 | 0.60 | 0.016 | 0.0010 | 0.0040 | 0.60 | 0.010 | 0.100 | 0.020 | | | 0.0025 | | 0.90 |
| Ex. 22 | 0.06 | 0.01 | 0.80 | 0.008 | 0.0015 | 0.0025 | 0.80 | 0.040 | 0.000 | 0.050 | 0.0025 | | 0.0025 | | 1.20 |
| Ex. 23 | 0.06 | 0.02 | 2.30 | 0.012 | 0.0020 | 0.0020 | 1.40 | 0.030 | 0.050 | | 0.0010 | | 0.0035 | | 3.00 |
| Ex. 24 | 0.06 | 0.02 | 1.56 | 0.012 | 0.0040 | 0.0025 | 1.70 | 0.010 | 0.030 | 0.020 | 0.0080 | | | | 2.41 |
| Ex. 25 | 0.08 | 0.015 | 0.80 | 0.015 | 0.0100 | 0.0035 | 0.60 | 0.040 | 0.020 | 0.070 | | 0.0020 | | 0.0100 | 1.10 |
| Ex. 26 | 0.04 | 0.01 | 3.20 | 0.016 | 0.0020 | 0.0040 | 1.20 | 0.040 | 0.200 | 0.150 | | | 0.0025 | | 3.80 |
| Ex. 27 | 0.04 | 0.01 | 1.23 | 0.008 | 0.0010 | 0.0025 | 1.40 | 0.010 | 0.230 | 0.050 | | | 0.0040 | | 1.93 |
| Ex. 28 | 0.04 | 0.005 | 1.56 | 0.002 | 0.0010 | 0.0015 | 2.00 | 0.040 | 0.150 | 0.030 | | | 0.0060 | 0.0300 | 2.56 |
| Ex. 29 | 0.05 | 0.015 | 0.80 | 0.015 | 0.0015 | 0.0035 | 1.50 | 0.020 | 0.060 | 0.030 | | | | | 1.55 |
| Ex. 30 | 0.05 | 0.01 | 1.20 | 0.016 | 0.0020 | 0.0040 | 0.80 | 0.040 | 0.020 | 0.070 | | | 0.0025 | | 1.60 |
| Ex. 31 | 0.05 | 0.01 | 2.50 | 0.008 | 0.0040 | 0.0025 | 1.40 | 0.040 | 0.040 | 0.020 | | | 0.0040 | | 3.20 |
| Ex. 32 | 0.08 | 0.005 | 1.56 | 0.002 | 0.0020 | 0.0015 | 2.00 | 0.010 | 0.230 | 0.050 | | | 0.0060 | | 2.56 |
| Comp. Ex. 1 | 0.005 | 0.01 | 3.00 | 0.015 | 0.010 | 0.0030 | 3.00 | 0.020 | 0.050 | 0.010 | | | 0.0025 | | 4.50 |
| Comp. Ex. 2 | 0.010 | 1.50 | 3.20 | 0.015 | 0.010 | 0.0030 | 2.10 | 0.010 | 0.050 | 0.050 | | | 0.0040 | | 4.25 |
| Comp. Ex. 3 | 0.015 | 1.50 | 2.20 | 0.001 | 0.002 | 0.0005 | 0.04 | 0.040 | 0.050 | 0.100 | | | 0.0060 | | 2.22 |
| Comp. Ex. 4 | 0.12 | 0.80 | 3.50 | 0.005 | 0.005 | 0.0010 | 1.20 | 0.020 | 0.100 | | 0.0010 | | | | 4.10 |
| Comp. Ex. 5 | 0.20 | 1.20 | 2.50 | 0.012 | 0.012 | 0.0050 | 0.04 | 0.020 | 0.300 | | 0.0080 | | | | 2.52 |
| Comp. Ex. 6 | 0.15 | 0.60 | 2.50 | 0.015 | 0.010 | 0.0030 | 0.05 | 0.010 | 0.400 | 0.050 | | | 0.0040 | | 2.53 |
| Comp. Ex. 7 | 0.12 | 0.80 | 3.50 | 0.005 | 0.005 | 0.0010 | 1.40 | 0.020 | 0.100 | | 0.0010 | | | | 4.20 |
| Comp. Ex. 8 | 0.20 | 0.01 | 2.50 | 0.012 | 0.012 | 0.0050 | 0.04 | 0.020 | 0.050 | 0.100 | 0.0080 | | | | 2.52 |
| Comp. Ex. 9 | 0.15 | 0.01 | 2.00 | 0.015 | 0.010 | 0.0030 | 0.05 | 0.010 | 0.100 | 0.050 | | | 0.0040 | | 2.03 |

Blank ingredient boxes indicate none added. Figures outside scope of invention are in italics.

TABLE 2-1

| | Air cooling start temperature (° C.) | Coiling temperature (° C.) | Tensile strength (N/mm$^2$) | Elongation (%) | λ value | Percent of ferrite having grain size of 2 μm or more (%) | Ability of phosphate coating | Remarks |
|---|---|---|---|---|---|---|---|---|
| Ex. 1 | 710 | 350 | 638 | 26 | 99 | 70 | G | |
| Ex. 2 | 700 | 550 | 1,012 | 15 | 62 | 42 | G | |
| Ex. 3 | 720 | 600 | 963 | 19 | 66 | 54 | G | |
| Ex. 4 | 650 | 450 | 692 | 28 | 94 | 82 | G | |
| Ex. 5 | 680 | 420 | 827 | 24 | 79 | 83 | G | |
| Ex. 6 | 720 | 380 | 708 | 24 | 89 | 65 | G | |
| Ex. 7 | 690 | 500 | 649 | 27 | 98 | 68 | G | |
| Ex. 8 | 710 | 520 | 725 | 24 | 88 | 66 | G | |
| Ex. 9 | 700 | 550 | 664 | 28 | 98 | 84 | G | |
| Ex. 10 | 720 | 480 | 615 | 32 | 109 | 95 | G | |
| Ex. 11 | 650 | 350 | 647 | 27 | 99 | 75 | G | |
| Ex. 12 | 680 | 550 | 656 | 26 | 97 | 69 | G | |
| Ex. 13 | 720 | 600 | 580 | 30 | 111 | 84 | G | |
| Ex. 14 | 690 | 450 | 777 | 24 | 83 | 74 | G | |
| Ex. 15 | 710 | 420 | 630 | 31 | 105 | 96 | G | |
| Ex. 16 | 700 | 380 | 643 | 26 | 98 | 69 | G | |
| Ex. 17 | 720 | 500 | 696 | 24 | 91 | 63 | G | |
| Ex. 18 | 650 | 350 | 843 | 22 | 76 | 59 | G | |
| Ex. 19 | 710 | 550 | 1,173 | 15 | 55 | 51 | G | |
| Ex. 20 | 700 | 600 | 934 | 21 | 70 | 74 | G | |

TABLE 2-2

| | Air cooling start temperature (° C.) | Coiling temperature (° C.) | Tensile strength (N/mm$^2$) | Elongation (%) | λ value | Percent of ferrite having grain size of 2 μm or more (%) | Ability of phosphate coating | Remarks |
|---|---|---|---|---|---|---|---|---|
| Ex. 21 | 720 | 450 | 648 | 26 | 98 | 71 | G | |
| Ex. 22 | 650 | 420 | 618 | 28 | 104 | 79 | G | |
| Ex. 23 | 680 | 380 | 748 | 26 | 87 | 78 | G | |
| Ex. 24 | 720 | 500 | 625 | 31 | 106 | 95 | G | |
| Ex. 25 | 690 | 350 | 701 | 24 | 91 | 67 | G | |
| Ex. 26 | 680 | 350 | 1,363 | 12 | 47 | 44 | G | |
| Ex. 27 | 720 | 600 | 992 | 18 | 65 | 59 | G | |
| Ex. 28 | 690 | 450 | 914 | 22 | 72 | 76 | G | |
| Ex. 29 | 690 | 350 | 640 | 29 | 102 | 92 | G | |
| Ex. 30 | 680 | 550 | 718 | 24 | 89 | 66 | G | |
| Ex. 31 | 720 | 600 | 787 | 24 | 82 | 72 | G | |
| Ex. 32 | 690 | 450 | 1,042 | 19 | 62 | 70 | G | |
| Comp. Ex. 1 | 650 | 500 | 771 | 30 | 88 | 96 | P | |
| Comp. Ex. 2 | 680 | 350 | 944 | 23 | 69 | 94 | P | |
| Comp. Ex. 3 | 720 | 550 | 1,019 | 15 | 61 | 45 | P | |
| Comp. Ex. 4 | 690 | 600 | 1,008 | 19 | 64 | 62 | P | |
| Comp. Ex. 5 | 680 | 450 | 1,313 | 9 | 48 | 33 | P | Low duct. |
| Comp. Ex. 6 | 690 | 450 | 1,521 | 5 | 41 | 10 | P | Low duct. |
| Comp. Ex. 7 | 690 | 600 | 1,008 | 20 | 64 | 66 | P | |
| Comp. Ex. 8 | 680 | 450 | 951 | 15 | 66 | 35 | G | Low duct. |
| Comp. Ex. 9 | 690 | 450 | 889 | 14 | 70 | 39 | G | Low duct. |

EXAMPLE 2

Steels of the ingredients shown in Table 3-1 and Table 3-2 were melted and cast into slabs by continuous casting in accordance with an ordinary method. Examples 33 to 58 show steels of ingredients in accordance with the present invention, Comparative Example 10 shows steel with amounts of addition of C and P outside the scope of the present invention, Comparative Example 11 shows steel with an amount of addition of Mn outside the scope, Comparative Example 12 shows steel with an amount of addition of Al outside the scope, Comparative Example 13 shows steel with amounts of addition of Si and Al outside the scope, Comparative Example 14 shows steel with amounts of addition of Si and Ti and V outside the scope, Comparative Example 15 shows steel with amounts of addition of Si and Nb outside the scope, and Comparative Example 16 shows steel with an amount of addition of Al outside the scope. Further, Comparative Example 10 shows steel with a formula (1) outside the scope of the present invention, while Comparative Example 11 shows steel with formulas (1) and (2) outside the scope.

These steels were heated in heating furnaces at temperatures of 1200° C. or more and were hot rolled to obtain 2.6 to 3.2 mm thick hot rolled steel sheets. The hot rolling conditions are shown in Table 4-1, Table 4-2, and Table 4-3.

In Table 4-1, 33-4 shows an example where the cooling rate is low and outside the scope of the present invention, 34-3 and 38-3 show air cooling start temperatures outside the scope of the present invention, and 37-3 and 39-3 show coiling temperatures outside the scope of the present invention. Further, 42-2 of Table 4-2 shows a shorter air cooling time.

Figure 3:
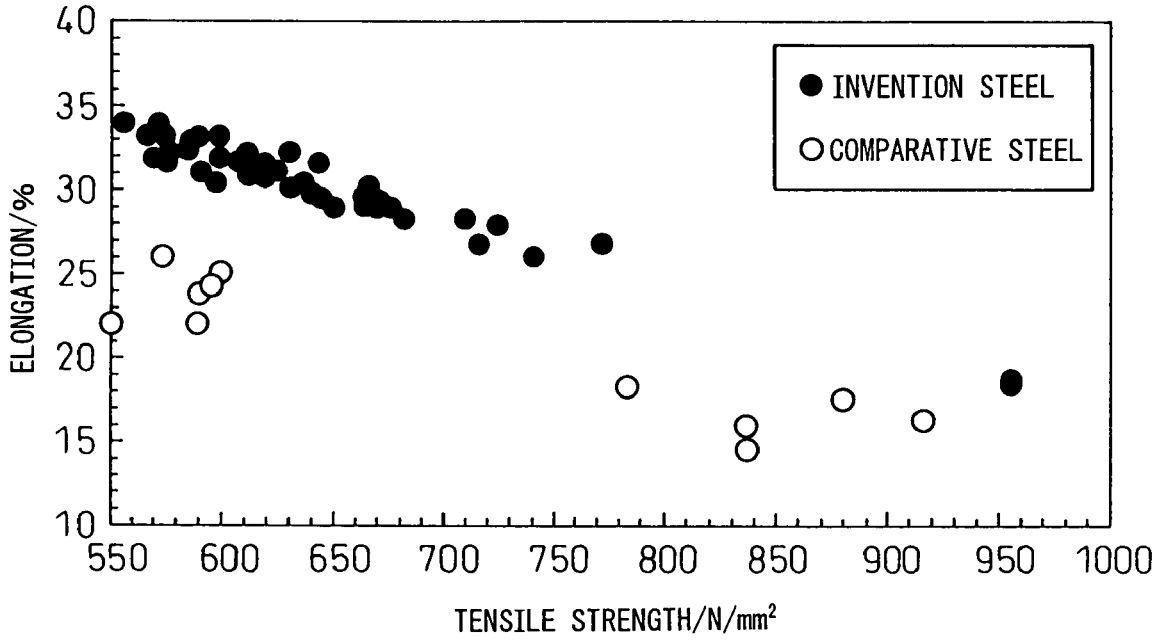
FIG. 3 is a view of the relationship between elongation and strength.

The thus obtained hot rolled steel sheets were tested for tensile strength and ability of phosphate coating. The TS, El, and phosphate coating of the test pieces are shown in Table 4-1, Table 4-2, and Table 4-3. FIG. 3 shows the relationship between strength and elongation. It is learned that the invention steels are higher in elongation compared with the comparative steels and therefore superior.

Note that the test methods of tensile strength and elongation, the method of measurement of the microstructure of the steel sheets, and the method of judgment of ability of phosphate coating are the same in conditions as Example 1.

TABLE 3-1

| | Steel composition (mass %) | | | | | | | | | | | |
|---|---|---|---|---|---|---|---|---|---|---|---|---|
| | C | Si | Mn | P | S | Al | Nb | Ti | V | Ca | Zr | REM |
| Ex. 33 | 0.060 | 0.010 | 1.500 | 0.018 | 0.003 | 0.300 | — | — | — | — | — | — |
| Ex. 34 | 0.055 | 0.300 | 1.220 | 0.011 | 0.002 | 0.250 | — | — | — | — | — | — |
| Ex. 35 | 0.060 | 0.005 | 1.200 | 0.015 | 0.004 | 0.400 | — | 0.020 | — | 0.003 | — | 0.004 |
| Ex. 36 | 0.060 | 0.100 | 1.100 | 0.005 | 0.002 | 0.300 | — | — | — | — | — | — |
| Ex. 37 | 0.060 | 0.010 | 1.220 | 0.006 | 0.003 | 0.450 | — | — | 0.180 | — | — | — |
| Ex. 38 | 0.065 | 0.010 | 1.220 | 0.006 | 0.003 | 1.000 | — | — | — | — | — | — |
| Ex. 39 | 0.060 | 0.010 | 1.500 | 0.011 | 0.002 | 0.800 | — | — | — | 0.002 | — | — |
| Ex. 40 | 0.060 | 0.020 | 1.400 | 0.007 | 0.004 | 0.800 | — | 0.020 | — | — | — | — |
| Ex. 41 | 0.070 | 0.010 | 1.300 | 0.010 | 0.004 | 0.900 | — | 0.030 | — | 0.003 | — | — |
| Ex. 42 | 0.080 | 0.010 | 3.000 | 0.008 | 0.002 | 1.700 | — | — | — | — | 0.001 | — |
| Ex. 43 | 0.080 | 0.400 | 2.000 | 0.008 | 0.003 | 0.300 | — | — | — | — | — | — |
| Ex. 44 | 0.075 | 0.020 | 0.600 | 0.012 | 0.009 | 0.400 | 0.035 | — | — | 0.003 | — | — |
| Ex. 45 | 0.080 | 0.005 | 1.400 | 0.015 | 0.003 | 0.250 | — | 0.190 | — | — | — | 0.005 |
| Ex. 46 | 0.080 | 0.020 | 1.500 | 0.012 | 0.002 | 0.300 | — | 0.020 | — | — | — | — |
| Ex. 47 | 0.080 | 0.010 | 1.400 | 0.011 | 0.003 | 0.350 | — | — | — | — | — | — |
| Ex. 48 | 0.075 | 0.010 | 1.600 | 0.006 | 0.004 | 0.350 | 0.020 | — | — | — | — | — |
| Ex. 49 | 0.080 | 0.010 | 1.600 | 0.015 | 0.004 | 0.400 | 0.010 | 0.010 | 0.050 | — | — | — |
| Ex. 50 | 0.080 | 0.020 | 1.600 | 0.011 | 0.004 | 0.900 | — | 0.025 | — | — | 0.008 | — |
| Ex. 51 | 0.080 | 0.020 | 1.600 | 0.015 | 0.003 | 1.000 | — | — | — | — | — | — |
| Ex. 52 | 0.080 | 0.005 | 1.400 | 0.015 | 0.003 | 1.400 | — | — | — | 0.003 | — | — |
| Ex. 53 | 0.025 | 0.020 | 1.400 | 0.012 | 0.003 | 0.800 | — | — | — | — | — | 0.001 |
| Ex. 54 | 0.050 | 0.010 | 2.000 | 0.025 | 0.003 | 0.900 | — | — | — | — | — | 0.006 |
| Ex. 55 | 0.050 | 0.020 | 2.200 | 0.008 | 0.003 | 0.900 | — | — | — | — | — | — |
| Ex. 56 | 0.060 | 0.010 | 2.000 | 0.017 | 0.003 | 0.900 | — | — | 0.010 | — | — | — |
| Ex. 57 | 0.060 | 0.250 | 2.200 | 0.017 | 0.003 | 0.200 | — | — | — | — | — | — |
| Ex. 58 | 0.060 | 0.350 | 2.400 | 0.016 | 0.003 | 0.250 | — | 0.025 | — | 0.003 | — | — |
| Comp. Ex. 10 | 0.100 | 0.300 | 3.400 | 0.040 | 0.003 | 1.900 | — | — | — | — | — | — |
| Comp. Ex. 11 | 0.060 | 0.200 | 4.000 | 0.020 | 0.003 | 1.000 | — | — | — | — | — | — |
| Comp. Ex. 12 | 0.060 | 0.100 | 1.500 | 0.020 | 0.003 | 0.030 | — | — | — | — | — | — |
| Comp. Ex. 13 | 0.055 | 0.700 | 1.500 | 0.020 | 0.004 | 2.500 | — | — | — | — | — | — |
| Comp. Ex. 14 | 0.056 | 0.800 | 1.100 | 0.020 | 0.010 | 0.200 | — | 0.220 | 0.300 | — | — | — |
| Comp. Ex. 15 | 0.060 | 1.500 | 2.000 | 0.020 | 0.002 | 0.200 | 0.050 | — | — | — | — | — |
| Comp. Ex. 16 | 0.060 | 0.300 | 2.000 | 0.020 | 0.004 | 3.000 | — | — | — | — | — | — |

TABLE 3-2

| | Equation 1, left side | Equation 2, right side | $Ar_3$ ° C. |
|---|---|---|---|
| Ex. 33 | 1.65 | −2.1 | 775 |
| Ex. 34 | 1.35 | −1.4 | 801 |
| Ex. 35 | 1.40 | −1.2 | 793 |
| Ex. 36 | 1.25 | −1.2 | 799 |
| Ex. 37 | 1.45 | −1.1 | 790 |
| Ex. 38 | 1.72 | 0.6 | 787 |
| Ex. 39 | 1.90 | −0.6 | 773 |
| Ex. 40 | 1.80 | −0.4 | 779 |
| Ex. 41 | 1.75 | 0.1 | 780 |
| Ex. 42 | 3.85 | −0.9 | 667 |
| Ex. 43 | 2.15 | −2.7 | 741 |
| Ex. 44 | 0.80 | 0.0 | 823 |
| Ex. 45 | 1.53 | −2.0 | 770 |
| Ex. 46 | 1.65 | −2.1 | 763 |
| Ex. 47 | 1.58 | −1.7 | 769 |
| Ex. 48 | 1.78 | −2.1 | 758 |
| Ex. 49 | 1.80 | −2.0 | 757 |
| Ex. 50 | 2.05 | −0.5 | 757 |

TABLE 3-2-continued

| | Equation 1, left side | Equation 2, right side | $Ar_3$ ° C. |
|---|---|---|---|
| Ex. 51 | 2.10 | −0.2 | 758 |
| Ex. 52 | 2.10 | 1.4 | 770 |
| Ex. 53 | 1.80 | −0.4 | 798 |
| Ex. 54 | 2.45 | −1.3 | 750 |
| Ex. 55 | 2.65 | −1.7 | 733 |
| Ex. 56 | 2.45 | −1.3 | 743 |

TABLE 3-2-continued

| | Equation 1, left side | Equation 2, right side | $Ar_3$ ° C. |
|---|---|---|---|
| Ex. 57 | 2.30 | −3.6 | 736 |
| Ex. 58 | 2.53 | −3.7 | 726 |
| Comp. Ex. 10 | 4.25 | −0.6 | 653 |
| Comp. Ex. 11 | 4.50 | −4.8 | 621 |
| Comp. Ex. 12 | 1.52 | −2.8 | 777 |
| Comp. Ex. 13 | 2.75 | 5.2 | 796 |
| Comp. Ex. 14 | 1.20 | −0.8 | 824 |
| Comp. Ex. 15 | 2.10 | −1.9 | 783 |
| Comp. Ex. 16 | 3.50 | 5.3 | 751 |

* where, $Ar_3 = 896 - 509(C\ \%) + 26.9(Si\ \%) - 63.5(Mn\ \%) + 229(P\ \%)$

TABLE 4-1

| | Finishing temperature ° C. | Cooling rate ° C./sec | Air cooling start temperature ° C. | Air cooling time sec | Coiling temperature ° C. | Percent of ferrite having grain size of 2 μm or more (%) | Tensile strength N/mm$^2$ | Elongation % | Ability of phosphate coating % |
|---|---|---|---|---|---|---|---|---|---|
| Ex. 33-1 | 920 | 70 | 670 | 4 | 100 | 85 | 589 | 33 | G |
| Ex. 33-2 | 910 | 70 | 710 | 3 | 100 | 56 | 569 | 32 | G |
| Ex. 33-3 | 920 | 40 | 660 | 3 | 100 | 73 | 599 | 32 | G |
| Ex. 33-4 | 930 | 10 | 750 | 5 | 100 | 72 | 589 | 22 | G |
| Ex. 34-1 | 920 | 70 | 670 | 3 | 100 | 73 | 585 | 32 | G |
| Ex. 34-2 | 900 | 70 | 720 | 3 | 250 | 56 | 575 | 32 | G |
| Ex. 34-3 | 910 | 70 | 780 | 2 | 100 | 20 | 590 | 24 | G |
| Ex. 34-4 | 890 | 40 | 680 | 2 | 100 | 55 | 590 | 31 | G |
| Ex. 35-1 | 910 | 70 | 670 | 3 | 100 | 74 | 585 | 32 | G |
| Ex. 35-2 | 920 | 40 | 700 | 2 | 100 | 49 | 597 | 30 | G |
| Ex. 36-1 | 890 | 70 | 670 | 4 | 100 | 89 | 571 | 34 | G |
| Ex. 36-2 | 930 | 70 | 650 | 3 | 250 | 81 | 556 | 34 | G |
| Ex. 37-1 | 930 | 70 | 670 | 3 | 100 | 75 | 566 | 33 | G |
| Ex. 37-2 | 920 | 40 | 700 | 3 | 100 | 64 | 576 | 32 | G |
| Ex. 37-3 | 920 | 70 | 720 | 3 | 350 | 57 | 551 | 22 | G |
| Ex. 38-1 | 910 | 70 | 680 | 3 | 100 | 79 | 573 | 33 | G |
| Ex. 38-2 | 910 | 40 | 720 | 4 | 100 | 80 | 585 | 33 | G |
| Ex. 38-3 | 890 | 70 | 630 | 3 | 100 | 92 | 573 | 26 | G |
| Ex. 39-1 | 920 | 70 | 680 | 3 | 100 | 74 | 607 | 32 | G |
| Ex. 39-2 | 920 | 70 | 700 | 3 | 100 | 67 | 619 | 31 | G |
| Ex. 39-3 | 930 | 40 | 700 | 4 | 350 | 82 | 599 | 25 | G |
| Ex. 40-1 | 910 | 70 | 690 | 3 | 100 | 71 | 608 | 31 | G |
| Ex. 40-2 | 900 | 40 | 730 | 4 | 100 | 72 | 620 | 31 | G |

TABLE 4-2

| | Finishing temperature ° C. | Cooling rate ° C./sec | Air cooling start temperature ° C. | Air cooling time sec | Coiling temperature ° C. | Percent of ferrite having grain size of 2 μm or more (%) | Tensile strength N/mm$^2$ | Elongation % | Ability of phosphate coating % |
|---|---|---|---|---|---|---|---|---|---|
| Ex. 41-1 | 920 | 70 | 680 | 3 | 100 | 77 | 623 | 31 | G |
| Ex. 41-2 | 910 | 40 | 700 | 3 | 100 | 70 | 635 | 30 | G |
| Ex. 42-1 | 880 | 70 | 670 | 4 | 100 | 91 | 771 | 27 | G |
| Ex. 42-2 | 870 | 40 | 720 | 1 | 100 | 28 | 783 | 18 | G |
| Ex. 43-1 | 910 | 70 | 670 | 4 | 100 | 82 | 724 | 28 | G |
| Ex. 43-2 | 890 | 70 | 680 | 4 | 250 | 78 | 709 | 28 | G |
| Ex. 44-1 | 890 | 70 | 670 | 3 | 100 | 80 | 548 | 34 | G |
| Ex. 44-2 | 910 | 40 | 710 | 3 | 250 | 66 | 533 | 34 | G |
| Ex. 45-1 | 890 | 70 | 670 | 3 | 100 | 70 | 955 | 19 | G |
| Ex. 45-2 | 890 | 50 | 680 | 3 | 100 | 66 | 955 | 18 | G |
| Ex. 46-1 | 880 | 70 | 680 | 3 | 100 | 66 | 669 | 29 | G |
| Ex. 46-2 | 890 | 30 | 690 | 3 | 100 | 63 | 681 | 28 | G |
| Ex. 47-1 | 920 | 70 | 670 | 3 | 100 | 71 | 611 | 31 | G |
| Ex. 47-2 | 910 | 70 | 690 | 3 | 100 | 64 | 611 | 31 | G |
| Ex. 48-1 | 890 | 70 | 680 | 3 | 100 | 66 | 663 | 29 | G |
| Ex. 48-2 | 900 | 70 | 700 | 4 | 100 | 74 | 663 | 30 | G |
| Ex. 49-1 | 900 | 70 | 670 | 4 | 100 | 85 | 665 | 30 | G |
| Ex. 49-2 | 890 | 150 | 660 | 3 | 100 | 74 | 665 | 29 | G |
| Ex. 50-1 | 920 | 70 | 680 | 3 | 100 | 74 | 663 | 30 | G |
| Ex. 50-2 | 920 | 40 | 690 | 3 | 100 | 71 | 675 | 29 | G |

TABLE 4-3

| | Finishing temperature ° C. | Cooling rate ° C./sec | Air cooling start temperature ° C. | Air cooling time sec | Coiling temperature ° C. | Percent of ferrite having grain size of 2 μm or more (%) | Tensile strength N/mm$^2$ | Elongation % | Ability of phosphate coating % |
|---|---|---|---|---|---|---|---|---|---|
| Ex. 51-1 | 930 | 100 | 660 | 4 | 100 | 98 | 630 | 32 | G |
| Ex. 51-2 | 910 | 70 | 720 | 3 | 100 | 62 | 630 | 30 | G |
| Ex. 52-1 | 900 | 70 | 680 | 3 | 100 | 84 | 611 | 32 | G |
| Ex. 52-2 | 910 | 40 | 700 | 3 | 100 | 77 | 623 | 31 | G |
| Ex. 53-1 | 890 | 70 | 680 | 4 | 100 | 90 | 525 | 36 | G |
| Ex. 53-2 | 890 | 40 | 700 | 3 | 100 | 68 | 537 | 34 | G |
| Ex. 54-1 | 890 | 70 | 660 | 3 | 100 | 77 | 619 | 31 | G |
| Ex. 54-2 | 900 | 70 | 660 | 4 | 250 | 92 | 599 | 33 | G |
| Ex. 55-1 | 920 | 70 | 700 | 3 | 100 | 61 | 644 | 29 | G |
| Ex. 55-2 | 930 | 70 | 660 | 3 | 250 | 75 | 624 | 31 | G |

TABLE 4-3-continued

| | Finishing temperature ° C. | Cooling rate ° C./sec | Air cooling start temperature ° C. | Air cooling time sec | Coiling temperature ° C. | Percent of ferrite having grain size of 2 μm or more (%) | Tensile strength N/mm$^2$ | Elongation % | Ability of phosphate coating % |
|---|---|---|---|---|---|---|---|---|---|
| Ex. 56-1 | 900 | 70 | 690 | 3 | 100 | 67 | 634 | 30 | G |
| Ex. 56-2 | 930 | 70 | 700 | 3 | 100 | 63 | 639 | 30 | G |
| Ex. 57-1 | 890 | 70 | 680 | 4 | 100 | 74 | 670 | 29 | G |
| Ex. 57-2 | 910 | 70 | 690 | 3 | 250 | 55 | 650 | 29 | G |
| Ex. 58-1 | 910 | 70 | 670 | 3 | 100 | 62 | 740 | 26 | G |
| Ex. 58-2 | 910 | 70 | 680 | 3 | 250 | 58 | 715 | 27 | G |
| Comp. Ex. 10 | 850 | 70 | 710 | 3 | 100 | 38 | 836 | 16 | P |
| Comp. Ex. 11 | 900 | 70 | 700 | 3 | 100 | 16 | 836 | 14 | P |
| Comp. Ex. 12 | 920 | 70 | 700 | 3 | 100 | 30 | 595 | 24 | G |
| Comp. Ex. 13 | 900 | 70 | 720 | 2 | 100 | 74 | 618 | 31 | P |
| Comp. Ex. 14 | 900 | 70 | 680 | 3 | 100 | 73 | 916 | 16 | P |
| Comp. Ex. 15 | 910 | 70 | 710 | 4 | 100 | 72 | 879 | 17 | P |
| Comp. Ex. 16 | 910 | 70 | 710 | 3 | 100 | 93 | 643 | 31 | P |

INDUSTRIAL APPLICABILITY

As explained in detail above, according to the present invention, high strength hot rolled steel sheet having a high strength of a tensile strength of 590 N/mm$^2$ or more and excellent in burring, elongation, and ability of phosphate coating can be economically provided, so the present invention is suitable as high strength hot rolled steel sheet having a high workability. Further, the high strength hot rolled steel sheet of the present invention enables reduction of the weight of car bodies, integral formation of parts, and streamlining of the working processes and therefore can contribute to the improvement of the fuel efficiency and reduction of production costs so is great in industrial value.

The invention claimed is:

1. High strength hot rolled steel sheet excellent in burring, elongation, and ability of phosphate coating characterized by being a steel composition containing, by mass%, C: 0.02 to 0.08%, Si: 0.25% or less, Mn: 0.50 to 3.50%, P: 0.03% or less, S: 0.01% or less, Al: 0.40 to 2.0%, Ti: 0.003 to 0.20%, and the balance of iron and unavoidable impurities, satisfying the following formula (1), the steel sheet being hot-rolled at a rolling end temperature of the Ar3point or more, then cooled by a cooling rate of 20° C./sec or more to 650 to 800° C., then air-cooled for 2 to 15 seconds, then further cooled by a cooling rate of 20° C./sec or more to 350 to 600° C. and coiled;

and the steel sheet having a microstructure of said steel sheet consisting essentially of a two phase structure of ferrite, having a grain diameter of 2 μm or more, and bainite, and having a ratio of ferrite of a grain size of 2 μm or more of at least 40%, and having precipitations of TiC and with a tensile strength of at least 590 N/mm$^2$:

and having a hole expandability ratio of 62% or higher, $$Mn+0.5\times Al<4 \quad (1).$$

2. High strength hot rolled steel sheet excellent in burring, elongation, and ability of phosphate coating characterized by having a tensile strength of at least 590 N/mm$^2$ as set forth in claim 1, further containing, by mass%, one or two or more of Nb: 0.003% to 0.04%, V: 0.003% to 0.20%, Ca: 0.0005 to 0.01%, Zr: 0.0005 to 0.01%, REM: 0.0005 to 0.05%, and Mg: 0.0005 to 0.01%.

3. High strength hot rolled steel sheet excellent in burring, elongation, and ability of phosphate coating characterized by having a tensile strength of at least 590 N/mm$^2$ as set forth in claim 1 or 2, characterized by satisfying $$0.3\times Al+Si-2\times Mn\geqq -4 \quad (2).$$

* * * * *